United States Patent [19]

Wolf

[11] Patent Number: 4,736,580

[45] Date of Patent: Apr. 12, 1988

[54] APPARATUS FOR MAKING TEXTILE FIBER STRANDS AND METHOD OF OPERATING SAME

[75] Inventor: Horst Wolf, Albershausen, Fed. Rep. of Germany

[73] Assignee: Zinser Textilmaschinen GmbH, Ebersbach/Fils, Fed. Rep. of Germany

[21] Appl. No.: 34,004

[22] Filed: Apr. 1, 1987

[30] Foreign Application Priority Data

Apr. 1, 1986 [DE] Fed. Rep. of Germany ..... 3610838

[51] Int. Cl.[4] ..... D01H 1/28; D01H 9/14; D01H 9/02

[52] U.S. Cl. ..... 57/100; 57/92; 57/266; 57/274; 57/276

[58] Field of Search ..... 57/92–97, 57/100, 266–268, 273, 274, 276, 277, 263, 264

[56] References Cited

U.S. PATENT DOCUMENTS 4,314,388 2/1982 Hartmannsgruber et al. ... 57/100 X 4,336,684 6/1982 Hartmannsgruber et al. ..... 57/93

FOREIGN PATENT DOCUMENTS 0061146 7/1985 European Pat. Off. .
1535062 7/1970 Fed. Rep. of Germany .
2118775 11/1971 Fed. Rep. of Germany .
2753924 2/1984 Fed. Rep. of Germany .
3507242 11/1985 Fed. Rep. of Germany .
645930 10/1984 Switzerland .

*Primary Examiner*—John Petrakes
*Attorney, Agent, or Firm*—Karl F. Ross; Herbert Dubno

[57] ABSTRACT

The apparatus for making textile fiber strands has a principal drive unit and at least one auxiliary drive unit. At least one alternating current motor of the principal drive unit is provided with a supply current of an adjustable frequency by a frequency converter. The frequency converter or at least one of the frequency converters is connectable to at least one alternating current motor of at least one of the auxiliary drive units in an intermediate time interval in which the receiving members of the apparatus for the fiber strands being produced are not loaded with the fiber strands.

9 Claims, 1 Drawing Sheet

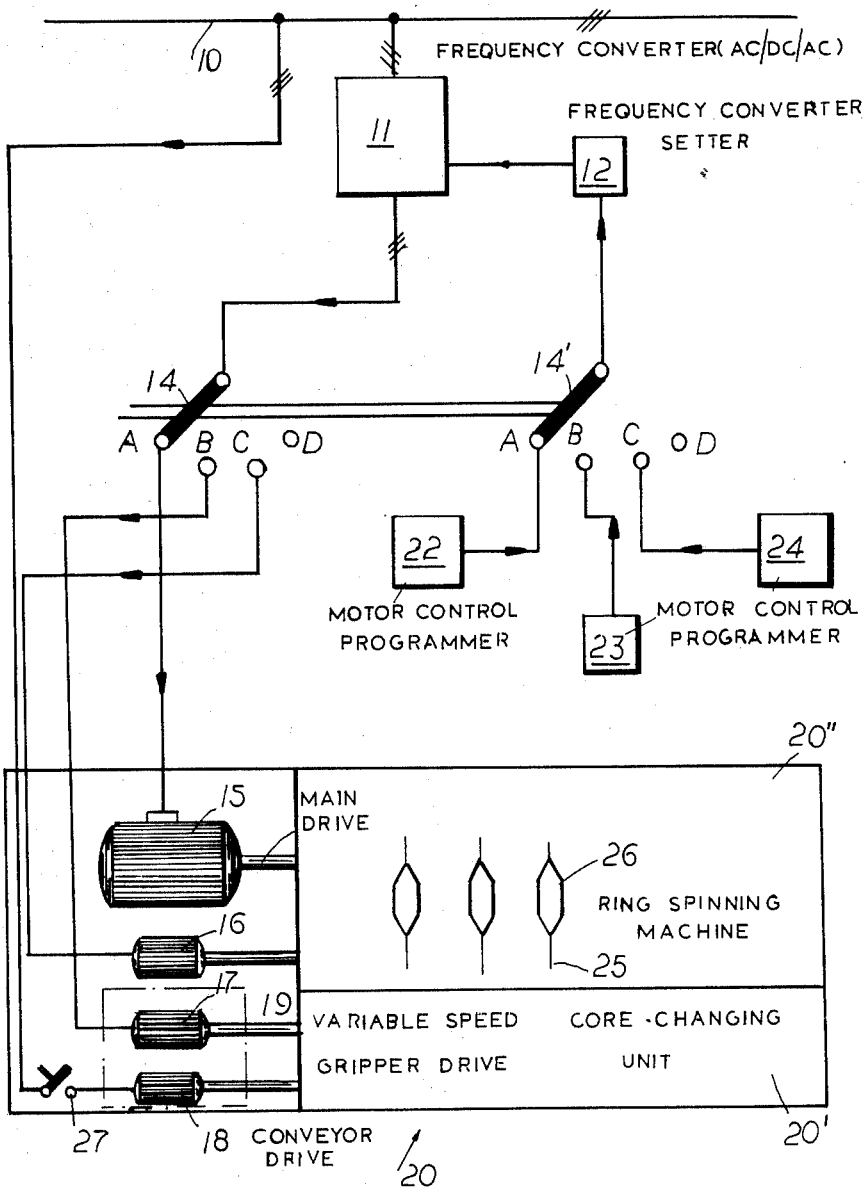
10
FREQUENCY CONVERTER (AC/DC/AC)
11
FREQUENCY CONVERTER SETTER
12
14
14'
A
B
C
D
A
B
C
D
22
24
MOTOR CONTROL PROGRAMMER
23
MOTOR CONTROL PROGRAMMER
20"
15
MAIN DRIVE
26
RING SPINNING MACHINE
25
16
17
19
VARIABLE SPEED GRIPPER DRIVE
CORE-CHANGING UNIT
27
18
CONVEYOR DRIVE
20
20'

APPARATUS FOR MAKING TEXTILE FIBER STRANDS AND METHOD OF OPERATING SAME

FIELD OF THE INVENTION

My present invention relates to an apparatus for making a plurality of textile fiber strands and to a method of operating same.

BACKGROUND OF THE INVENTION

An apparatus for making a plurality of textile fiber strands is known which has a multiplicity of receiving members for receiving the fiber strands made in a plurality of principal or main time intervals.

These receiving members (e.g. spools) are replaced by empty receiving members in intermediate time intervals between principal time intervals. A plurality of manufacturing devices work together to make the fiber strands which are fed to the receiving members and are driven by a principal drive unit.

These manufacturing devices have at least one alternating current motor and at least one frequency converter. One of the frequency converters acts to supply at least one of the alternating current motors of the principal drive unit with an adjustable frequency current.

The apparatus also has at least one auxiliary drive unit which at least acts to supply power for changing the receiving members in an intermediate or intervening time interval.

By alternating current motors I mean standard electric motors which are supplied with a single or polyphase current. Synchronous or asynchronous motors can be used. Advantageously the alternating current motors can be polyphase motors.

My invention can advantageously be applied to spinning machines, drafting rolls and flyers.

The spinning machine can advantageously be a ring spinning machine, a bell spinning machine, combing machine or the like. The apparatus however can comprise a part or portion of a machine or of several machines connected together.

A ring spinning machine can often be divided into two or more portions producing yarn independently of each other, for example, into two longitudinal machine halves. Here each longitudinal machine half is a device for making fiber strands.

It can comprise several carding devices connected with a set of drafting rolls or a drafting mill associated with them producing a fiber strand.

The replaceable receiving members of such fiber manufacturing unit include spinning cans, spools or bobbins. However there are also other receiving members, for example spinning tops in spinning top spinning machines.

These machines manufacture or process roving, fiber strands, yarn or thread, hereinafter referred to generically as fiber strands.

In the textile fiber strand making unit described above there is a main drive unit which acts to drive its producing components. By producing components I mean here all parts which work together in making the fiber strands winding them on spools, bobbins or the like or feeding them into cans, spinning tops or the like.

During an intervening time interval the receiving members no longer are fed with fiber strands. However it is possible in many cases to make fiber strands for a short time at the beginning of an intervening interval.

Then the fiber strands are not conducted to the receiving members but to other locations in the unit, e.g. to lower winding positions of the spindles of the ring spinning machine where they are wound.

A main time interval thus begins after an exchange of the receiving members as soon as the initially empty receiving member starts to be supplied with some fiber strand and ends when the loading of the receiving member with fiber strands ends for the purpose of the replacement.

During the intervening time interval the full receiving member now fully loaded during the previous main time interval is replaced by an empty receiving member.

The production of the fiber strands and their feeding to the receiving member can then begin again, i.e. then a main time interval starts.

During a main time interval the fiber manufacturing unit produces fiber strands uninterruptedly. It is also possible to interrupt this production without changing the receiving members. Such interruption times are counted as part of the main time interval.

In the unit to which the invention is related the main drive unit can have a single electric drive motor in many cases which is normally an asynchronous motor supplied with three phase current which is supplied by a frequency converter and is controllable in its rotation speed by adjustment of the output frequency of the frequency converter. This control allows adjustment of the rotation speed of this motor continuously or in steps by a frequency converter corresponding to a continuous or stepped adjustment of the output frequency thereof.

However in some manufacturing units, the main drive unit has many electrical alternating current motors instead of a single drive motor. It can be associated with or provided with a common frequency converter or a number of frequency converters to supply only one motor or a portion of the motors of the main drive unit and to supply the other motors of the main drive unit in another way, for example advantageously directly from the a.c. line current source. It is known to drive each spindle of a ring spinning machine individually by its own alternating current motor and to drive the drafting rolls by another or several other alternating current motors.

One common frequency converter can then be associated with all these motors or only the spindle drive motors or only the drive motors for the drafting rolls.

It is also possible to provide several frequency converters for all these motors.

In such a unit it is frequently the case that an automatically operating changing device is provided for replacement of full bobbins or receiving members with empty bobbins or receiving members. This changing device is drivable using an auxiliary drive unit.

Also one or more auxiliary drive units can be used for other purposes, e.g. for ring banks of a ring spinning machine or the ring bank of one half of a ring spinning machine after disconnecting the ring spinning machine during its run down period so that the yarn produced during the run down period is not wound on the bobbins but on the lower winding locations of the spindle.

At least one auxiliary drive unit can be provided for the drive of some other aggregate or member, e.g. cleaning devices performing cleaning tasks in the intervening time interval and/or control devices performing control operations and/or restoring devices performing restoring operations.

Frequency converters are comparatively expensive. For this reason in many applications, economical pole changing alternating current electric motors may be provided even though the frequency converter in itself is better for the rotational speed control of the alternating current motor on account of the stepwise continuous frequency variation of the current of the alternating current motor. Pole changeable electric motors allow only a few different rotation speed steps while the output frequencies of the frequency converters are adjustable over a wide range continuously or if necessary in small steps. Thus the rotation speed of each of the alternating current motors is more readily controllable with frequency converters. Also pole changeable motors are comparatively large and require more space than alternating current motors which are not pole changeable.

OBJECTS OF THE INVENTION

It is an object of my invention to provide an improved apparatus for making textile fiber strands whereby the drawbacks of earlier control systems are avoided.

It is also an object of my invention to more economically use a frequency converter of the main drive unit in an apparatus for making textile fiber strands similar to that described above.

It is another object of my invention to provide an improved method of operating an apparatus for making textile fiber strands in which the rotation speed of the receiving members for the fiber strands can be accurately but economically adjusted, particularly during intervening time intervals.

SUMMARY OF THE INVENTION

These objects and others which will become more readily apparent hereinafter are attained in accordance with my invention in an apparatus for making a multiplicity of textile fiber strands which has a multiplicity of receiving members for receiving the fiber strands made in a multiplicity of main time intervals.

These receiving members are replaced by empty receiving members at intervening time intervals between main time intervals.

A multiplicity of manufacturing devices or mechanisms work together to make fiber strands which are fed to the receiving members and are driven by a main drive unit.

These manufacturing devices have at least one alternating current motor and at least one frequency converter.

One of the frequency converters acts to supply at least one of the alternating current motors of the main drive unit with an adjustable frequency.

The apparatus also has at least one auxiliary drive unit which at least acts to supply power for replacement of the receiving members in the intervening time intervals.

According to my invention a frequency converter or at least one of the frequency converters is connectable in the intervening time intervals to at least one of the alternating current motors of at least one of the auxiliary drive units for supply of the associated ones of the alternating current motors with an adjustable frequency, the motors having speeds dependent upon the frequency with which they are energized.

Several advantages are attained. The frequency converter is put to better use and is more economical than the other control expedients. Also now a frequency converter in many cases in an apparatus for manufacture of fiber strands has a tolerable cost, being utilized more efficiently, although its use up to now had been prohibitively expensive. Thus the properties of the unit are considerably improved.

Also the supply of at least one alternating current motor of at least one auxiliary drive unit by the frequency converter permits the alternating current motor to be adjusted in its rotation speed continuously or in steps which allows significantly improved accurate and sensitive operation of the operating members driven by the alternating current motors. The auxiliary drive unit also is improved in its operation.

Other variations of my invention are possible. The main drive unit and/or at least one of the auxiliary drive units can be associated with a program control unit for programmable control of the output frequency or an associated one of the frequency converters. The auxiliary drive unit or at least one of the auxiliary drive units can act to drive a changing device for changing the receiving members.

BRIEF DESCRIPTION OF THE DRAWING

The above and other objects, features and advantages of my invention will become more readily apparent from the following description, reference being made to the accompanying highly diagrammatic drawing in which the sole FIGURE is a diagram showing an apparatus for making textile fiber strands according to my invention.

SPECIFIC DESCRIPTION

My invention can be applied to a ring spinning machine or other standard spinning machine. The spinning machine described here is a ring spinning machine 20.

This ring spinning machine 20 has a main drive unit which has a single drive motor 15. However if necessary also a multiplicity of alternating current motors and in many cases also motors of other kinds can be used (provided of course, the motor speed is controlled by input frequency).

Furthermore this spinning machine 20 has two auxiliary drive units with motors 16, 17 and 18.

All motors 15 to 18 are preferably three phase or polyphase alternating current motors.

The motor 16 forms an auxiliary drive unit for the ring bank or ring banks of the ring spinning machine 20.

The motor 16 functions as follows: During every main time interval the primary components of the ring spinning machine 20 including the drafting rolls, spindles and ring bank or banks indicated schematically as the block 20'' produce yarn which is wound on receiving members 26 which in this example are bobbins mounted on the spindles 25.

The main drive motor 15 then drives the drafting rolls, the ring bank and the spindles 25 of this ring spinning machine.

At the end of the main time interval the drive motor 15 is disconnected and the ring spinning machine 20 now runs down to a stop.

During this shut off period an intervening time interval begins when the ring bank is lowered by motor 16 into a position in which the yarn made during the shut off of the ring spinning machine is no longer wound on the receiving members 26 but now on the lower winding positions on the spindles 25. The motor 16 operates under load at the beginning of each intervening time interval.

The motors 17 and 18 comprise a second auxiliary drive unit for driving a changing device 20' acting to replace full bobbins in the ring spinning machine 20 with empty bobbins.

This changing device 20' can have one or more conveyor belts as is known which are driven by an on/off motor 18 activated by a switch 27 and which acts among other things to transfer the empty bobbins required by the changing process to a gripping mechanism driven by the motor 17. This gripping mechanism first takes the full bobbin and puts it on this conveyor belt. After that it grasps the empty bobbin and puts it on the spindle; such changes are conventional.

The motion cycle of this gripping mechanism is provided by using a polyphase or three phase motor in a comparatively broad range continuously or in a multiplicity of discrete steps. This occurs here using the motor 17 and the frequency converter 11 connectable to its voltage supply. The motor 18 needs on the other hand only one rotation speed to run and can thus be connected by the switch 27 directly to the a.c. line circuit source 10.

The frequency converter 11 is also connected to the a.c. line circuit source 10. Preferably the frequency converter 11 is an a.c. to d.c. to a.c. frequency converter which has a particularly large output frequency range.

The output frequency of the output current of the frequency converter 11 is continuously adjustable in steps by a controlling member 12 which controls the direct current-alternating current inverter of this frequency converter 11. The controlling member 12 is connectable by a selector switch 14' to either of three program control units 22, 23 and 24. This selector switch 14' is coupled mechanically with an additional selector switch 14 which connects either the motor 15, the motor 16 and/or the motor 17 to the frequency converter 11. Further the switches 14 and 14' have empty contacts D for jointly disconnecting the motors 15, 16 and 17 from the program control units 22, 23 and 24.

This apparatus operates as follows:

During each intervening time interval the full bobbins found on the spindles are replaced for empty bobbins by a changing device 20' shown schematically as a block.

The ganged switches 14 and 14' are jointly switched to their switch contact B.

The program control unit 23 controls then the switch 27 for the on/off motor 18 for the conveyor belt in an appropriate way. Furthermore it controls the output frequency of the frequency converter 11 by appropriate control of the controlling member 12 as required for driving the gripping member of the changing device 20'.

The frequency converter 11 supplies and controls the motor 17 so that the program control unit 23 can cause the gripping member to perform a suitable motion with different rotation speeds of the motor 17 driven by it. As is required a rotation direction reversal of the drive motor 17 can be programmed or the program control unit can likewise control the electromagnetic coupling, reversing gear or the like which controls the reversal of the gripping mechanism. Essentially the output frequency can be programmably adjusted over wide limits as to its outlet frequency so that correspondingly the rotation speed of the motor 17 can be programmably adjusted over wide limits. Thus the optimum running speed of the gripping member can be achieved by the motor 17 under control of the programmable control unit 23.

Once the bobbin changing process is complete, a main time interval can be initiated and for that purpose the switches 14 and 14' are shifted so that the motor 15 is supplied by the frequency converter 11 with current of an adjustable frequency.

This adjustment of the output frequency of this frequency converter and thus the rotation of the main drive motor 15 is programmable by the program control unit 22. Thus the start up of the ring spinning machine can be programmed to occur from a condition where the operating rotation speed is zero. This results by action of the controlling member 12 and the frequency converter 11 programmable by the program control unit 22.

Also the operating speed of the ring spinning machine can be changed continuously during the main time interval as is desired. For example the speed of the ring spinning machine depends on the motion of the ring bank for reduction of the fiber tension variations continuously.

When the material wound on the bobbins during the main time interval has reached its provided final size, the main drive motor 15 is shut off. During this operation the operating speed can be programmably reduced from its present operating speed.

The shut off of the motor 15 is effected by changing the switch 14 and thus also the switch 14' to make connection to the contact C and thus the motor 16 is activated and an intervening time interval is initiated.

The rotation speed of the motor 16 is variably adjustable in a predetermined way by the program control unit 24 by the controlling member 12 and the frequency converter 11 so that during this shut down of the ring spinning machine the ring bank is moved so that the yarn produced is wound on the lower winding positions of the spindles. Subsequently the switches 14 and 14' are changed to their switch contacts B and thus the full bobbins found on the spindles of the ring spinning machine 20 are replaced by empty bobbins by the changing device 20' by the program controlling device 23. After that the switches 14 and 14' can again be changed to the switching contact A to make yarn once again.

By manufacturing devices which produce the textile fiber strands I mean to include those portions of the spinning machine which produce the fiber strands which includes any carding devices and/or drafting rolls present.

I claim:

1. In an apparatus for making a multiplicity of textile fiber strands which has a multiplicity of receiving members for receiving said multiplicity of said textile fiber strands made in one of a multiplicity of main time intervals wherein the receiving members are each replaceable by an empty one of said receiving members in a multiplicity of intervening time intervals between said main time intervals, a multiplicity of manufacturing devices working together to make said textile fiber strands fed to said receiving members to be received thereby and driven by a main drive unit, said main drive unit having at least one alternating current motor, and at least one frequency converter supplying said alternate current motor of said main drive unit with an adjustable frequency, said apparatus also having at least one auxiliary drive unit having at least one alternating current motor which acts to supply power for changing said receiving members in said intervening time interval, the improvement wherein said frequency converter is connectable in said intervening time intervals to at least one of said alternating current motors of at least one of said auxuiliary drive units for supplying the motors with said adjustable frequency.

2. The apparatus according to claim 1 wherein said main drive unit and said auxuiliary drive unit are each associated with a program control unit for programmable control of an output frequency of an associated one of said frequency converters.

3. The apparatus according to claim 1 wherein said auxiliary drive unit acts to drive a changing device for changing said receiving members.

4. An apparatus for making a multiplicity of textile fiber strands comprising:

a multiplicity of receiving members for receiving said multiplicity of said textile fiber strands made in a multiplicity of main time intervals which receiving members are each replaceable by an empty one of said receiving members in a multiplicity of intervening time intervals between said main time intervals;

a multiplicity of manufacturing devices working together to make said textile fiber strands fed to said receiving members to be received thereby;

a main drive unit driving said manufacturing devices having at least one alternating current motor;

at least one auxuliary drive unit having at least one alternating current motor which acts to supply power for changing said receiving members in said intervening time intervals;

at least one frequency converter which acts to supply at least one of said alternating current motors of said main drive unit with an adjustable frequency, said frequency converter or at least one of said frequency converters in said intervening time intervals being connectable to at least one of said auxiliary drive units for supply of the associated ones of said alternating current motors with said adjustable frequency;

a program control unit for programmable control of an output frequency of one of said frequency converters associated with said main drive unit and at least one of said auxiliary drive units; and a changing device for changing said receiving members driven by at least one of said auxiliary drive units.

5. A method of operating a textile machine wherein a main a.c. drive motor drives a plurality of elements normally producing fiber strands and winding up said strands and at least one further a.c. drive motor is energized during a time interval at which said main drive motor is at standstill to carry out auxiliary machine operations involving said elements, said method comprising the steps of:

(a) energizing said main a.c. drive motor with a frequency converter having a variable frequency output from an a.c. line-current source during main time intervals for normal operation to produce and wind up said strands;

(b) interrupting the energization of said main a.c. drive motor by said frequency converter for intervening time intervals between said main time intervals, thereby intermittently terminating the winding up of said strands; and (c) during said intervening time intervals switching said frequency converter from said main a.c. drive motor and connecting said frequency converter to feed said further a.c. drive motor, and controlling the frequency output of said frequency converter when it is connected to said further a.c. drive motor to vary the speed thereof for said auxiliary machine operations.

6. The method defined in claim 5 wherein said frequency converter receives an input from a main drive motor programmer during said main time intervals, said method further comprising the step of concurrently switching a further drive motor programmer to control said frequency converter upon switching of said frequency converter from said main a.c. drive motor and connecting said frequency converter to feed said further a.c. drive motor.

7. In a textile machine wherein a main a.c. drive motor drives a plurality of elements normally producing fiber strands and winding up said strands and at least one further a.c. drive motor is energized during a time interval at which said main drive motor is at standstill to carry out auxiliary machine operations involving said elements, and wherein control means is provided for controlling the operation of said motors, the improvement wherein said control means comprises:

(a) means for energizing said main a.c. drive motor with a frequency converter having a variable frequency output from an a.c. line-current source during main time intervals for normal operation to produce and wind up said strands;

(b) means for interrupting the energization of said main a.c. drive motor by said frequency converter for intervening time intervals between said main time intervals, thereby intermittently terminating the winding up of said strands; and (c) switching means effective during said intervening time intervals for switching said frequency converter from said main a.c. drive motor and connecting said frequency converter to feed said further a.c. drive motor, and controlling the frequency output of said frequency converter when it is connected to said further a.c. drive motor to vary the speed thereof for said auxiliary machine operations.

8. The improvement defined in claim 7 wherein said frequency converter receives an input from a main drive motor programmer during said main time intervals, said control means further comprising means for concurrently switching a further drive motor programmer to control said frequency converter upon switching of said frequency converter from said main a.c. drive motor and connecting said frequency converter to feed said further a.c. drive motor.

9. The improvement defined in claim 8 wherein said elements include spools adapted to take up said strands and said further drive motor drives a spool-changing mechanism forming part of said machine.

* * * * *